United States Patent [19]

Ewig, Jr. et al.

[11] 4,136,547

[45] Jan. 30, 1979

[54] RIVETER

[75] Inventors: John F. Ewig, Jr., Worcester; Jon S. Gardner, Marlboro, both of Mass.

[73] Assignee: Parker Manufacturing Company, Worcester, Mass.

[21] Appl. No.: 893,354

[22] Filed: Apr. 4, 1978

[51] Int. Cl.[2] ..... B21J 15/34

[52] U.S. Cl. ..... 72/391

[58] Field of Search ..... 72/391, 114; 29/243.5, 29/243.53, 243.54

[56] References Cited

U.S. PATENT DOCUMENTS

| | | | |
|---|---|---|---|
| 1,829,696 | 10/1931 | Wylie | 72/391 |
| 2,399,442 | 4/1946 | Luce | 72/391 |
| 3,548,627 | 12/1970 | Henshaw | 72/391 |
| 3,760,627 | 9/1973 | Richardson | 72/391 |

FOREIGN PATENT DOCUMENTS

| | | | |
|---|---|---|---|
| 478535 | 1/1938 | United Kingdom | 72/391 |

*Primary Examiner*—C.W. Lanham
*Assistant Examiner*—Gene P. Crosby
*Attorney, Agent, or Firm*—Norman S. Blodgett; Gerry A. Blodgett

[57] ABSTRACT

A tool for setting blind hollow rivets which include a mandrel to be pulled from the accessible side of work to set the rivet on the blind side. The tool includes a body, a pulling device movable relative to the body, a pair of actuating levers pivoted to the body, and linkage means connected to each of the levers and connected at a single point to the pulling device.

10 Claims, 2 Drawing Figures

RIVETER

BACKGROUND OF THE INVENTION

The present invention is directed to an improved riveting tool adapted for use in setting blind or hollow rivets.

The expression "blind riveting" is used herein to denote a procedure in which a hollow rivet is inserted through a hole in the work. The rivet is set at one side of the work by application of a pull to the rivet mandrel.

The invention is particularly directed to the type of riveting tool that is purely mechanical in nature and which includes one or more handles providing sufficient mechanical advantage to the operator by hand. Since considerable force is required to set the rivet, the design of the actuating mechanism is such as to produce a high mechanical advantage to create the desired force. However, in many cases this mechanical advantage produces very little pulling and several operations of the actuating mechanisms are required before the mandrel is pulled a sufficient amount to set the rivet. In addition, the attempts to produce sufficient mechanical advantage together with a sufficient degree of pulling of the mandrel has resulted in complicated actuating elements comprising a system of links and levers. Previous designs have tended to make the riveting tool cumbersome and difficult to operate, as well as making the tool difficult to manufacture, assemble and, thereby more expensive.

Mechanical hand-operated riveting tools of the prior art generally comprise a pulling device movable relative to a main body. The pulling device includes jaw elements comprise one or more handles pivotally attached to the body and connected to the pulling device through linkage elements. Examples of this type of riveting tool are shown in the U.S. Pat. Nos. to Luce 2,399,442 issued Apr. 30, 1946 and Henshaw 3,548,627 issued Dec. 22, 1970. While the construction shown and described in these two patents provides an adequate mechanical advantage for the actuating elements, there are some disadvantages. The multiplicity of pivotal connections produces mechanical losses. The fact that the handles are pivoted on the body at points outside of the main portion of the body reduces the amount of effective motion produced by the handle for a given handle opening. The connecting links are connected to the pulling device at points on opposite sides of the longitudinal axis of the pulling. A moment arm is thereby created between the axis of the pulling device and each pivotal connection between the pulling device and one of the links. If the force exerted by each link is not perfectly synchronized, a binding action is produced between the pulling device and the corresponding portion of the body on which the pulling device moves. It is also possible to pinch one's fingers between the handles and the connecting links and between the handles or links and the body. These and other difficulties experienced with the prior art devices have been obviated by the present invention.

It is, therefore, an outstanding object of the invention to provide a riveting tool in which the links which connect the actuating lever or handles to the pulling device at a common point and preferably along the central longitudinal axis of the pulling element, so as to direct all pulling forces to a single part of the pulling device and to eliminate any moment arms which causes the binding of the pulling device on the body.

Another object of this invention is the provision of a riveting tool in which a pair of handles or actuating levers are pivotally connected to the body at a common point, providing for maximum effective motion of the handles when they are moved together in a rivet setting operation.

A further object of the present invention is the provision of a riveting tool in which the links are connected to the pulling element at a common point and the actuating levers or handles are connected to the body at a common point and both of these points are located along the central longitudinal axis of the pulling element, thereby providing maximum operating efficiency of the actuating elements.

It is another object of the instant invention to provide a riveting tool in which all of the links are pivotal connections are enclosed within a protective outwardly and rearwardly extending portion of the body for preventing injury to the user.

A still further object of the invention is the provision of a riveting tool which is simplified in design and yet is rugged and efficient in use.

It is a still further object of the invention to provide a riveting tool which is simple in construction, which is inexpensive to manufacture, and which is capable of a long life of useful service with a minimum of maintenance.

It is a further object of the invention to provide a riveting tool having sufficient mechanical advantage together with a sufficient amount of pulling motion to enable a hollow rivet to be set with one actuating motion of the handles.

With these and other objects in view, as will be apparent to those skilled in the art, the invention resides in the combination of parts set forth in the specification and covered by the claims appended hereto.

SUMMARY OF THE INVENTION

In general, the invention consists of a riveting tool for use in setting blind or hollow rivets to a workpiece. The tool is provided with a main body having an elongated barrel and a pulling device movable within a bore of the barrel and including jaws adapted to be opened in their foremost position to permit release or insertion of the mandrel and adapted when moved from the foremost position to a rearmost position to grip and pull the mandrel from an inserted hollow rivet. The actuating mechanism for the tool includes a pair of levers or handles which are pivotally connected to the body and linkage means connecting the levers to the pulling device. The links are connected to the pulling device at a common point along the central longitudinal axis of the pulling device and the actuating levers are pivotally connected to the body also at a common point and also along the central longitudinal axis of the pulling element. The bore of the body extends outwardly and rearwardly in fan-shape fashion to completely enclose the links and the portions of the levers which are pivotally connected to the links and to the body. Preferably, the handles are U-shaped overlapping portions by which the levers are commonly pivoted to the main body.

BRIEF DESCRIPTION OF THE DRAWINGS

The character of the invention, however, may be best understood by reference to one of its structural forms, as illustrated by the accompany drawings, in which.

DESCRIPTION OF THE PREFERRED EMBODIMENT

Figure 1:
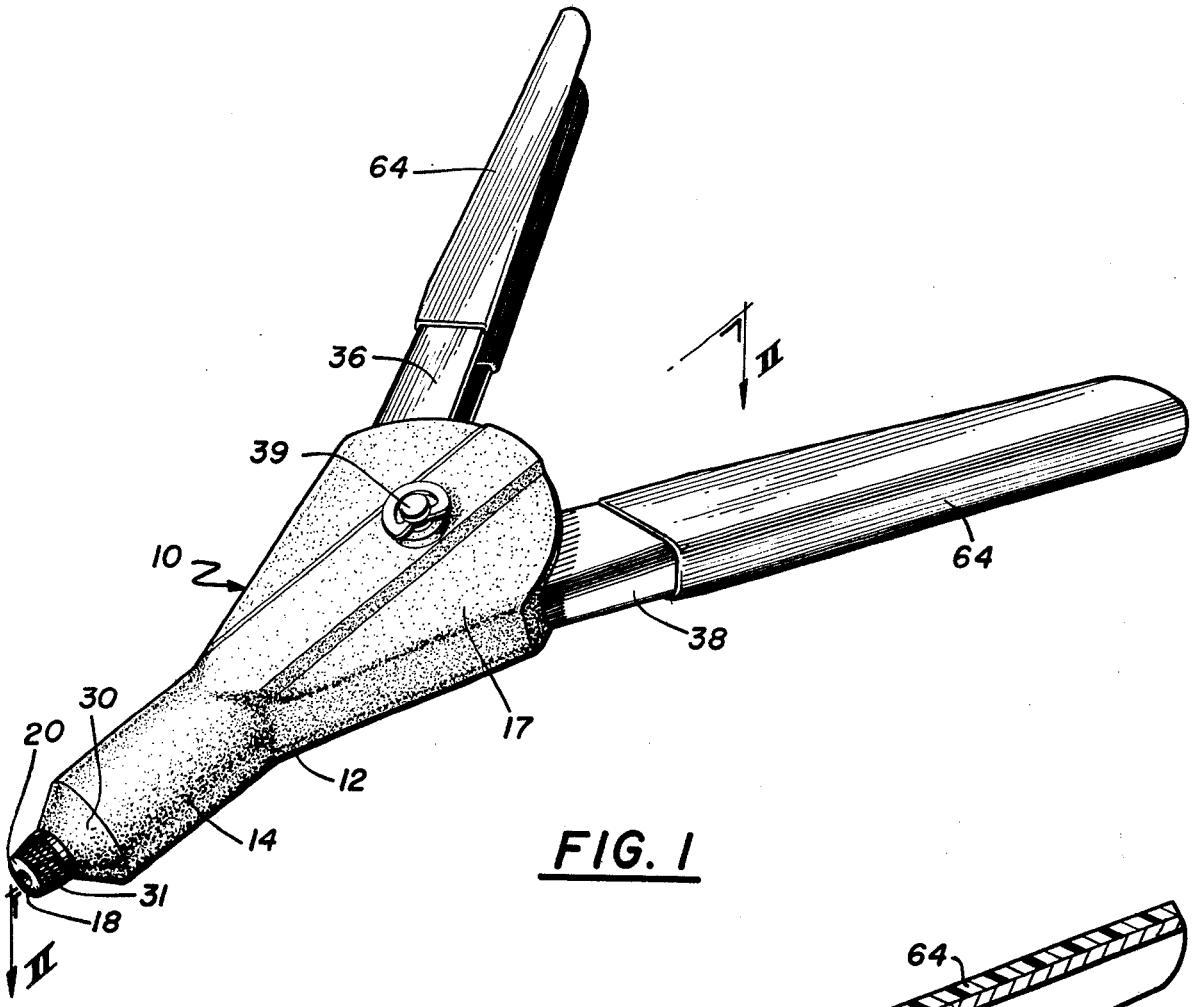
FIG. 1 is a perspective view of the riveting tool embodying the principles of the present invention.

Referring to the figures, the rivet gun, indicated generally by the reference numeral 10, is shown as being the type intended for use in applying a hollow rivet having a mandrel to a workpiece. The gun is provided with a main body 12, having an elongated barrel 14 containing a bore 16. The body flares outwardly and rearwardly from the barrel to form a generally flattened V-shaped enclosure indicated at 17. A rivet anvil 18 is mounted on one end of the barrel 12 and is provided with a mandrel-receiving bore 20 which is concentric with an axis extending longitudinally of the barrel. A piston 22 is slidable in bore 16 and includes a bore 24, the foreward end of which has a conical portion 26. Mandrel gripper jaws 28 are movable in the conical portion 26 of the piston bore for movement toward and away from the rivet mandrel.

The barrel 14 is provided with a conical surface 30 at the anvil end. Surface 30 merges with a conical outer surface 31 on the rivet anvil 18. A gripper bushing 32 is also slidable in the piston bore 24 and a coil spring 33 lies under compression between the rearward end of the piston 22 and the bushing 32. The gripper jaws are provided with a conical recess is engaged by a similarly-formed conical protuberance 34 on the forward or adjacent end of the bushing 32.

The mechanism just described forms a pulling device for the rivet handle. However, the invention is not limited to the particular pulling device shown and described in this application. Any known pulling device which moves relative to a main body from a foremost position to permit release or insertion of the mandrel to a rearmost position for gripping and pulling the mandrel of an inserted rivet to set the same may be used. The improvement lies in the particular configuration of the body and the mechanism for actuating the pulling device in combination with a pulling device modified as shown herein.

Figure 2:
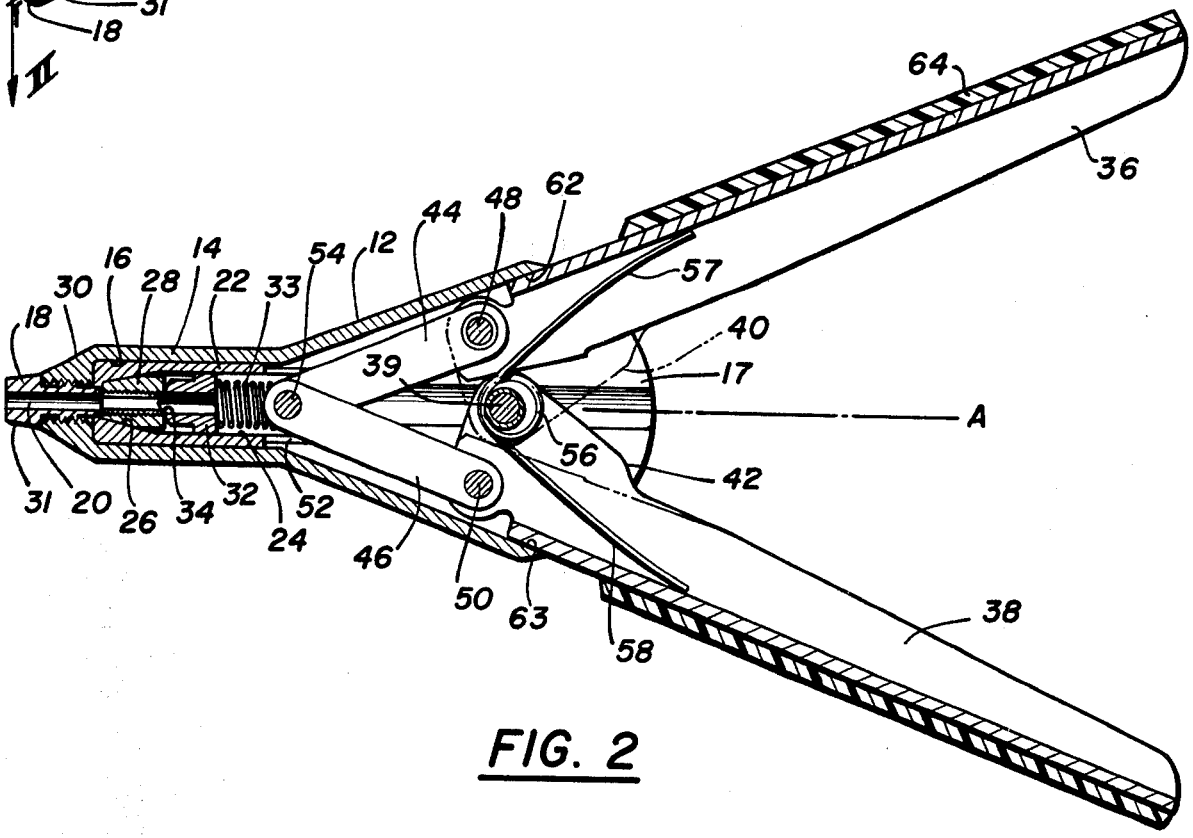
FIG. 2 is a horizontal sectional view of the riveting tool taken on the line II—II of FIG. 1.

The actuating mechanism for the mandrel pulling device includes first and second levers or handles 36 and 28, respectively, pivotally mounted on the main body 12 by means of a pivot pin 39 which extends through the V-shaped enclosure 17. Each of the levers 36 and 38 are U-shaped in cross-section, the adjacent legs of which are enlarged at their forward ends so that they overlap as shown in FIG. 2. The enlarged leg portion of lever 36 has been broken away in FIG. 2 and is indicated by dot and dash lines 40. The enlarged leg portion of lever 38 is indicated by reference numeral 42. Pin 39 extends through the overlapping enlarged portions 40 and 42 to pivotally anchor the handles 36, 38, to the body 12. A pair of links 44 and 46 are pivotally connected to handles 36 and 38, respectively, by means of pins 48 and 50, respectively. The opposite ends of both links 44 and 46 extend into a slot 52 in the piston 22 and are pivotally mounted in this slot by means of a pivot pin 54. As can be seen in FIG. 2, pivot pins 48 and 50 form first and second pivot points which are spaced from each other an equi-distant from the pivots 50 and 39 which form third and fourth pivot points, respectively. Pins 54 and 39 are located on the central longitudinal axis A—A of the pulling device and pivot pins 48 and 50 are located equal distances on opposite sides of this axis. A spring 56 is mounted on pin 39 and includes elongated pins 57 and 58 which extend into the U-shaped form of handles 36 and 38 to bias the handles in the separated position shown in FIG. 2. The spread of the levers is limited by the inside surfaces 62 and 63 of the side walls of the closure 17, walls 62 and 63 are engaged by the respective base portions of U-shaped handles 36 and 38 and act as stops for the handles. As can be seen in the figures, when the handles are in their spread or open position, they extend from the main body at the same angle as that of the V-shaped enclosure 17. If desired, the outer surfaces of handles 36 and 38 may also be provided with a gripping material indicated at 64.

The operation and advantages of the present invention will now be readily understood in view of the above description. The blind rivet is mounted on the rivet anvil 18 by passing the mandrel of the rivet through the bore 20, so that it lies between the gripper jaws 28. The flange of the rivet portion rest against the front portion of the holes of the angle 18. The operator holds the riveting tool by grasping the handles 36 and 38 and inserts the rivet through the two elements that are to be fastened together. The operator then squeezes the handles 36 and 38 together causing pivot pin 48 to rotate in a clockwise direction around pivot pin 39 and pivot pin 50 to rotate in a counter-clockwise direction around pivot pin 39 as viewed in FIG. 2. This movement causes links 44 and 46 to be pulled rearwardly simultaneously so as to pull the pulling device rearwardly of the rivet anvil 18. The movement of the pulling device to the right as viewed in FIG. 2 causes the jaws 28 to grip the mandrel by means of the action of the conical portion 26 of the piston bore acting on a conical portion 26 of the piston bore acting on a conical portion of the gripper jaws. The mandrel, therefore, is moved to the right as viewed in FIG. 2 and this movement of the mandrel causes the head of the mandrel to collapse the free end of the hollow rivet on the other side of the workpiece elements which are to be fastened. In most cases, a single actuating movement of the levers 36 and 38 is enough to collapse the rivet to form a flange on the backside of the articles to be fastened together. However, if a single squeezing of the levers 36 and 38 does not completely collapse the rivet, the handles are released to their open position allowing the piston 22 and the gripper jaws to be moved forwardly to the left as viewed in FIG. 2, thereby releasing the grip of the jaws 28 on the mandrel. The handles 36 and 38 are then again squeezed together causing the gripper jaws to once again grip the rivet mandrel and pull it an additional amount to the right to break the mandrel in the customary way and the riveting operation is completed. The operator then moves the riveting tool away from the completed rivet. He then releases his grip on the handles 36 and 38 which allows the pulling elements to return to their original forward position allowing the broken pieces of mandrel to drop out of the bore 20 in the rivet anvil.

It can be seen, therefore, by pivotally attaching both links at a common point to the piston 22 on the central longitudinal axis of the piston, binding moment arms are thereby eliminated. Further, by pivotally attaching the handles 36 and 38 at a common point on the body and, preferably on the same axis as that of pivot pin 54, a maximum effective motion is achieved for a given lever opening, the normal lever opening being determined by the usual grasping span of a user. In addition, the location of pivot pins 54 and 39 along the central longitudinal axis of the pulling device means that most of the forces are concentrated along this axis, providing for the efficient transmission of force to the rivet. The construction of the actuating mechanism of the present invention also involves fewer parts which contributes to a more useful longer life of the tool and enables the tool to be manufactured and assembled more economically. Since all of the connecting and pivoting portions of the actuating mechanism lie within the closure 17, the riveting tool of the present invention also provides an appealing and safe tool for the user.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. A riveting tool for use with a hollow rivet having a mandrel, comprising:

(a) a main body having an elongated barrel which contains a bore, (b) a pulling device movable within said bore and including jaws, the foremost position of the pulling device being determined by abutment with a portion of the body of the tool, the jaws being adapted to be opened in their foremost position to permit release or insertion of a mandrel therebetween, and adapted when moved from said foremost position to a rearmost position to grip and pull the mandrel of an inserted hollow rivet, (c) a first lever, one end of which is pivotally connected to the body and the other end of which extends rearwardly of the body, (d) a second lever, one end which is pivotally connected to the body and the other end of which extends rearwardly of the body, (e) linkage means pivotally connected at first and second points to the first and second levers, respectively, and to the pulling device at a third point, said first and second points being spaced from the pivotal connection of each lever on the body so that divergence of the extending ends of the levers causes the pulling device to move toward said rearmost position and convergence of said extending ends causes the pulling device to move toward said foremost position, and (f) means for biasing the levers so that the rearwardly extending portions of said levers diverge.

2. A riveting tool as recited in claim 1, wherein said bore flares outwardly and rearwardly to enclose said linkage means and the portions of the first and second levers which are pivotally connected to the body.

3. A riveting tool as recited in claim 1, wherein said pulling device includes a slot at its rearmost end and extending along the longitudinal axis of said pulling device, the linkage means being pivotally connected to said pulling device within said slot.

4. A riveting tool as recited in claim 1, wherein the first and second levers are pivoted to the body at a common fourth point.

5. A riveting tool as recited in claim 4, wherein each of said levers are U-shaped in cross-section including inwardly extending leg portions, one leg of the first lever overlapping with one leg of the second lever at said fourth point.

6. A riveting tool as recited in claim 5, wherein the overlapping portions of said legs are longer than the remaining portions thereof.

7. A riveting tool as recited in claim 5, wherein said biasing means comprises a compression spring which engages the base portions of said U-shaped levers.

8. A riveting tool as recited in claim 7 comprising a pivot pin at said fourth pivot point, wherein said spring includes a central portion encircling said pivot pin, and end portions which extend into the U-shaped configuration of the first and second levers.

9. A riveting tool as recited in claim 4, wherein said third and fourth points are located on the central longitudinal axis of the pulling device.

10. A riveting tool as recited in claim 4, wherein said third point is located between the jaws of the pulling device and the fourth point.

* * * * *